US007837483B2

(12) United States Patent
Haut et al.

(10) Patent No.: US 7,837,483 B2
(45) Date of Patent: Nov. 23, 2010

(54) FLUSH/RECESSABLE JUNCTION DEVICE

(75) Inventors: David Haut, Gladstone, NJ (US); Mirek Bogdanowicz, Manville, NJ (US)

(73) Assignee: Hautlet, LLC, Gladstone, NJ (US)

( * ) Notice: Subject to any disclaimer, the term of this patent is extended or adjusted under 35 U.S.C. 154(b) by 0 days.

(21) Appl. No.: 12/454,786

(22) Filed: May 22, 2009

(65) Prior Publication Data

US 2009/0291585 A1 Nov. 26, 2009

Related U.S. Application Data

(60) Provisional application No. 61/128,476, filed on May 22, 2008.

(51) Int. Cl.
*H01R 13/44* (2006.01)

(52) U.S. Cl. ..... 439/131

(58) Field of Classification Search ..... 439/131, 439/170, 373; 174/53–59
See application file for complete search history.

(56) References Cited

U.S. PATENT DOCUMENTS

| | | | | |
|---|---|---|---|---|
| 949,123 | A | 2/1910 | Klein | |
| 1,160,187 | A | 11/1915 | Meschenmoser | |
| 1,171,914 | A | 2/1916 | Wright | |
| 1,219,908 | A | 3/1917 | Both | |
| 1,328,224 | A | 1/1920 | Benjamin | |
| 2,196,842 | A | 4/1940 | Strazzabosco | |
| 2,256,716 | A * | 9/1941 | Klancnik | 337/187 |
| 3,197,598 | A | 7/1965 | Andersen et al. | |
| 3,433,886 | A * | 3/1969 | Myers | 174/57 |
| 3,573,344 | A * | 4/1971 | Snyder | 174/57 |
| 3,612,953 | A * | 10/1971 | Gittin et al. | 361/104 |
| 3,742,414 | A * | 6/1973 | Gittin et al. | 337/206 |
| 3,972,579 | A | 8/1976 | Kohaut | |
| 4,059,327 | A | 11/1977 | Vann | |
| 4,165,443 | A * | 8/1979 | Figart et al. | 174/53 |
| 4,361,375 | A | 11/1982 | Bailey et al. | |
| 4,383,148 | A * | 5/1983 | Arima et al. | 200/61.54 |
| 4,493,517 | A | 1/1985 | Hillary | |
| 4,504,103 | A * | 3/1985 | Woedl | 439/131 |
| 4,551,577 | A | 11/1985 | Byrne | |
| 4,593,960 | A * | 6/1986 | Millhimes et al. | 439/140 |
| 4,688,135 | A * | 8/1987 | Leopold | 361/118 |
| 4,984,982 | A | 1/1991 | Brownlie et al. | |
| 4,993,970 | A | 2/1991 | Littrell | |
| 5,023,396 | A * | 6/1991 | Bartee et al. | 174/486 |
| 5,171,939 | A * | 12/1992 | Shotey | 174/67 |
| 5,223,673 | A * | 6/1993 | Mason | 174/53 |
| 5,516,298 | A * | 5/1996 | Smith | 439/131 |

(Continued)

*Primary Examiner*—T C Patel
*Assistant Examiner*—Vladimir Imas
(74) *Attorney, Agent, or Firm*—Lerner, David, Littenberg, Krumholz & Mentlik, LLP

(57) ABSTRACT

A recessable junction device includes a body having at least one track, the at least one track having a plurality of locking regions, and at least one receptacle configured to connect with a power source or signal source, or both a power and a signal source, the at least one receptacle slidably mounted within the body by engagement with the at least one track. The junction device further includes a locking lever having a first unlocked and extended position to allow grasping of the locking lever to move the at least one receptacle relative to the body and a second locked position that prevents movement of the at least one receptacle relative to the body in each of the plurality of locking regions.

18 Claims, 5 Drawing Sheets

U.S. PATENT DOCUMENTS 5,574,256 A 11/1996 Cottone
5,575,668 A * 11/1996 Timmerman ..... 439/131
5,596,174 A * 1/1997 Sapienza ..... 174/57
5,888,078 A * 3/1999 Lecreux et al. ..... 439/131
5,934,917 A 8/1999 Haut
6,028,267 A * 2/2000 Byrne ..... 174/59
6,085,667 A * 7/2000 Gevaert et al. ..... 108/50.02
6,086,390 A 7/2000 Haut
6,175,078 B1 * 1/2001 Bambardekar et al. ..... 174/484
6,278,059 B1 * 8/2001 Lefton ..... 174/50
6,435,903 B1 * 8/2002 Nelson ..... 439/528
6,527,566 B1 * 3/2003 Lambiaso ..... 439/131
6,530,806 B2 * 3/2003 Nelson ..... 439/528
6,533,225 B1 * 3/2003 Berges et al. ..... 248/27.1
6,767,228 B2 * 7/2004 Katz ..... 439/140
6,773,276 B2 * 8/2004 Ziegler et al. ..... 439/131
6,870,099 B1 * 3/2005 Schultz et al. ..... 174/53
6,872,086 B2 * 3/2005 Milan ..... 439/131
7,034,222 B1 * 4/2006 York ..... 174/50
7,078,618 B2 * 7/2006 Dinh ..... 174/481
7,160,147 B1 * 1/2007 Stephan ..... 439/535
7,276,661 B2 * 10/2007 Wegner et al. ..... 174/58
7,395,598 B2 * 7/2008 Kidman ..... 29/825
7,501,575 B2 * 3/2009 Jolly ..... 174/50
7,557,308 B2 * 7/2009 Dinh ..... 174/481
7,637,385 B2 * 12/2009 Wegner et al. ..... 220/3.7
2002/0182907 A1 * 12/2002 Katz ..... 439/140

* cited by examiner

FLUSH/RECESSABLE JUNCTION DEVICE

CROSS-REFERENCE TO RELATED APPLICATIONS

This application claims the benefit of the filing date of U.S. Provisional Patent Application No. 61/128,476 filed May 22, 2008, the disclosure of which is hereby incorporated herein by reference.

FIELD OF THE INVENTION

The invention relates to flush/recessable junction devices and more particularly to improved flush/recessable junction devices for easily and safely grasping, locking, unlocking, and moving receptacles, which are mounted within or carried by a structure such as a wall, article of furniture, or piece of electronic or other equipment, between flush and recessed locked positions.

BACKGROUND OF THE INVENTION

Many types of equipment carry a receptacle which enables connection with and disconnection from a source of supply of power and/or signals required to operate the equipment. Such services may include: electricity for power required to operate home appliances and equipment, office and industrial equipment; telephone lines for incorporation of equipment and/or internal communication networks; and cable and twin-lead lines for connection of receiving equipment to antennas and computer equipment peripherals.

The source of the service(s) may either be located within the place of use (such as a home, office, or business) as, for example, a central server or similar equipment for a computer network or other computer accessories, or it may be remote from the place of use (such as a generating station for electricity). Such service(s) are often distributed within the place of use by wiring, coax cable or the like which terminates at one or more junction devices each equipped with one or more coupling devices constructed to mate with the part of the coupling device carried by the equipment, for example, a wall outlet and a plug to supply power to a computer.

If the service is power electricity the equipment will usually carry a length of electric cord or cable terminating in a male plug to be mated with a female receptacle located in a junction device in a wall or floor, or carried by a desk or other article of furniture, fixture, or equipment. Communication equipment, such as telephones, usually include a line terminating in a modular phone-type connector for mating engagement with a modular jack; while coaxial cable and twin-lead, in turn, may be fitted with male bayonet-type connectors for mating engagement with respective female type connections located in a junction device. Connections for computers to other computers in a network and/or to peripheral equipment such as printers, scanners, CD readers, etc. also use communication type electrical lines with mating male and female couplings and connectors.

It is highly desirable to have ready access to the respective coupling parts when plugging equipment in to a power and/or signal source. The part carried by the equipment is usually the male part, such as a plug, and is most often disposed at the end of a length of wire. The female part is typically positioned in a junction device disposed within a wall or other surface. The male and female coupling parts may be reversed, however, the equipment carried part is usually disposed at the end of a length of wire and the mating part is usually disposed to be flush to a surface at a junction device.

Connection of the mating coupling parts is aided by the length of conduit, wire or conductor carried by the equipment and by the relatively fixed placement of the other mating part of the coupling. For example, flat screen televisions are typically plugged into an outlet and a coaxial cable feed is mounted in a wall. However, once coupled and placed near the wall, the mated coupling parts, such as plugs, or coaxial cables often protrude and form an obstruction which interferes with disposition of the equipment, or the unit or furniture upon which the equipment is located. For example, after plugging in a computer to an outlet and an internet cable feed and locating the computer on a desk, it may be impossible to push the desk against the wall in which the outlet is located because the plug protrudes from the wall. Thus, when pushing furniture or equipment against a connection, the connector may be damaged causing a decrease in signal fidelity, a failed connection and/or an unsafe condition. Spacing of the equipment or furniture from such surfaces may prove unsafe and undesirable because the equipment or furniture may project into a pathway and/or because things may fall between the equipment or furniture and the surface carrying the junction device.

Thus, flush/recessable junction devices have been proposed. However, there is a need to improve such devices, particularly in cases where it is desirable to easily change the position of the receptacle from a flush to a recessed position or a recessed to a flush position, and easily lock the receptacle in either a flush or recessed position. The need for improved devices which are easier to flush and recess is especially important in cases where the equipment may be relocated or reconfigured often, such as in business offices, where changes in personnel and equipment location occur relatively frequently. Further, the devices are needed to improve safety, reliability, reduce manufacturing costs and allow for a simple, easy to use reconfigurable device. Still further, improved devices are needed when recessing or making flush a coupling within a junction device in a confined space.

BRIEF SUMMARY OF THE INVENTION

In one aspect of the invention, a recessable junction device is provided comprising a body having at least one track, the at least one track having a plurality of locking regions; at least one receptacle configured to connect with a power source or signal source, or both a power and a signal source, the at least one receptacle slidably mounted within the body by engagement with the at least one track. The at least one receptacle comprises a locking lever having a first unlocked and extended position to allow grasping of the locking lever to move the at least one receptacle relative to the body and a second locked position that prevents movement of the at least one receptacle relative to the body in at each of the plurality of locking regions.

Preferably, the plurality of locking regions correspond to a first locked position wherein the face of the at least one receptacle is substantially aligned with the front edge of the body, and a second locked position wherein the face of the at least one receptacle is remote from the front edge of the body and substantially recessed within the body. More preferably, movement of the locking lever to the second locked position locks the at least one receptacle at two opposing locking regions.

The receptacle can also be connectable to a power source and/or signal source by one or more wires, and the recessable junction device preferably includes one or more wire guides comprising one or more channels for retaining at least portions of the wires within the channels when the at least one receptacle is moved between the locking regions.

Also in a preferred embodiment, the body can include at least one contact terminal, at least one wire guide, and at least one terminal protector, wherein the at least one receptacle is connected to at least one wire, and wherein the at least one terminal protector is positioned at an angle towards the at least one wire guide and between the at least one contact terminal and the at least one receptacle to assist the guidance of the at least one wire into the wire retaining channel and provide at least a partial barrier between the at least one wire and the at least one contact terminal.

Another preferred embodiment provides a recessable junction device comprising a body comprising at least one contact terminal, the body further defining an opening having a receptacle disposed therein, wherein the receptacle is moveable within the opening between a plurality of positions relative to the body; at least one wire connecting the receptacle and the at least one contact terminal, wherein the at least one wire remains connected to the receptacle and the at least one contact terminal at all of the plurality of positions of the receptacle relative to the body; and at least one wire guide comprising one or more channels for retaining at least portions of at least one wire connected to the receptacle within the channels when the receptacle is moved between positions.

Desirably, the receptacle has at least one receptacle surface and the body has at least one external surface, and wherein the receptacle surface is substantially flush with the external surface of the body when the receptacle is in at least one of the plurality of positions and the receptacle surface is substantially recessed from the external surface of the body when the receptacle is in at least another one of the plurality of positions.

The body may also further comprises at least one contact terminal and at least one terminal protector, wherein the at least one terminal protector is positioned at an angle towards the at least one wire guide and between the at least one contact terminal and the at least one receptacle to assist the guidance of the at least one wire into the wire retaining channel and provide at least a partial barrier between the at least one wire and the at least one contact terminal.

Yet another preferred embodiment provides a recessable junction device comprising a body comprising one or more contact terminals and defining an opening, the opening having a receptacle disposed therein, wherein the receptacle is moveable between a plurality of positions relative to the body; and the body further comprising one or more terminal protector walls positioned at an angle between the contact terminals and bendable wiring connected to the receptacle to assist guiding at least a portion of the wiring away from the contact terminals during movement of the receptacle within the opening.

Desirably, the receptacle has at least one receptacle surface and the body has at least one external surface, and wherein the receptacle surface is substantially flush with the external surface of the body when the receptacle is in at least one of the plurality of positions and the receptacle surface is substantially recessed from the external surface of the body when the receptacle is in at least another one of the plurality of positions. The receptacle can also comprise a locking lever having a first unlocked position to allow grasping of the locking lever to move the receptacle within the body and a second locked position wherein a locking movement of the locking lever causes the receptacle to lock at a desired one of the plurality of positions.

In yet another preferred arrangement, the recessable junction device has a housing having a body, the body having a first locking region and at least a second locking region; at least one receptacle connectable to a power source and/or signal source, the at least one receptacle being movable within the housing between the first locking region and the at least one second locking region; and a locking lever having one or more locking elements, the locking lever being movable between (i) a first open position for grasping by a user to allow the user to move the at least one receptacle between the first and the at least one second locking regions and (ii) a second closed position by which movement of the locking lever from the first open position to the second closed position causes the one or more locking elements to engage and lock the receptacle against the housing to prevent movement of the receptacle within the housing.

Preferably, the housing comprises slots, and the locking lever comprises rails that change position as the locking lever is moved from the first open to the second closed position to engage the slots of the housing. The locking lever may also be movable to a position flush with the face of the receptacle when the receptacle is in a locked position with respect to the housing and movable to a position outwardly extending from the face of the receptacle when the receptacle is moveable with respect to the housing. Still further, the receptacle may include a top outlet and a bottom outlet, each outlet being connectable to a power source and/or a signal source, and wherein the locking lever is arranged between the top outlet and the bottom outlet.

A preferred method of the present invention provides a method of moving and locking at least one movable receptacle in a recessable junction device, including: providing a flush/recessable junction device comprising a housing and at least one receptacle movable within the housing, the receptacle comprising a locking lever movable between a locked and unlocked position, and the housing having at least a first locking region and a second locking region; moving the locking lever to the unlocked position; grasping the locking lever while in the unlocked position to move the at least one receptacle to the first locking region; moving the locking lever to the locked position to lock the at least one receptacle in the first locking region; moving the locking lever to the unlocked position to unlock the at least one receptacle from the first locking region; grasping the locking lever while in the unlocked position to move the at least one receptacle to the second locking region; and moving the locking lever to the locked position to lock the at least one receptacle at the second locking region.

Preferably, the locking lever includes one or more rails slidable within one or more tracks provided in the housing, and the method further comprising rotating the locking lever to change the position of the rail to lock or unlock the at least one receptacle The present invention also preferably provides a flush/recessable junction device that comprises a housing having a body. The body has at least one track, at least one of the tracks has at least a first locking region and a second locking region. At least one receptacle has a face and one or more connection elements connectable with a power source and/or signal source or equipment, the at least one receptacle being slidably mounted within the housing by engagement with the at least one track. A locking lever has a first open position for grasping by a user to allow the user to move the at least one receptacle within the housing and a second closed position for preventing movement of the at least one receptacle within the housing at the at least first and second locking regions.

In a preferred embodiment, the flush/recessable junction device has first and the second locking regions corresponding to a first flush locked position, wherein the face of the at least one receptacle is substantially aligned and coplanar with the housing and wherein the at least one receptacle can be coupled to the power source and/or signal source or equipment to conduct power and/or signals to or from the power and/or signal source or equipment with the at least one receptacle remaining in the first flush locked position; and a second recessed locked position, wherein the face of the at least one receptacle is substantially recessed within the housing and wherein the at least one receptacle can be coupled to the power source and/or signal source or equipment to conduct power and/or signals to or from the power and/or signal source or equipment with the at least one receptacle remaining in the second recessed locked position.

In alternate embodiments, the connection elements may comprise wires. In other embodiments, the flush/recessable junction device may further comprise one or more wire guides for containing at least portions of the wires when the at least one receptacle is moved between the locking regions.

In yet another embodiment, the flush/recessable junction device has a locking lever which locks the at least one receptacle at two opposing first locking regions or two opposing second locking regions.

In still another embodiment, the flush/recessable junction device has a plurality of locking regions for locking the at least one receptacle at a plurality of different positions.

In another aspect of the invention, a method of recessing at least one receptacle in a flush/recessable junction device includes providing a flush/recessable junction device having a housing having one or more tracks, at least one receptacle, and a locking lever, movable between a locked and unlocked position, the at least one receptacle being slidable within the housing along the one or more tracks, the one or more tracks having at least a first locking region and a second locking region. The method may further include moving the position of the locking lever to lock the at least one receptacle in a first flush locked position, wherein the face of the at least one receptacle is substantially aligned and coplanar with the housing, whereby the locking lever engages the first locking region. Furthermore, the method may include moving the position of the locking lever to unlock the at least one receptacle such that the at least one receptacle is movable from the first flush locked position; and moving the at least one receptacle to a second recessed locked position where the face of the at least one receptacle is substantially recessed within the housing and. In addition, the method may include moving the position of the locking lever to the locked position to lock the at least one receptacle at the second recessed locked position, whereby the locking lever engages the second locking region.

DETAILED DESCRIPTION OF THE INVENTION

Figure 1:
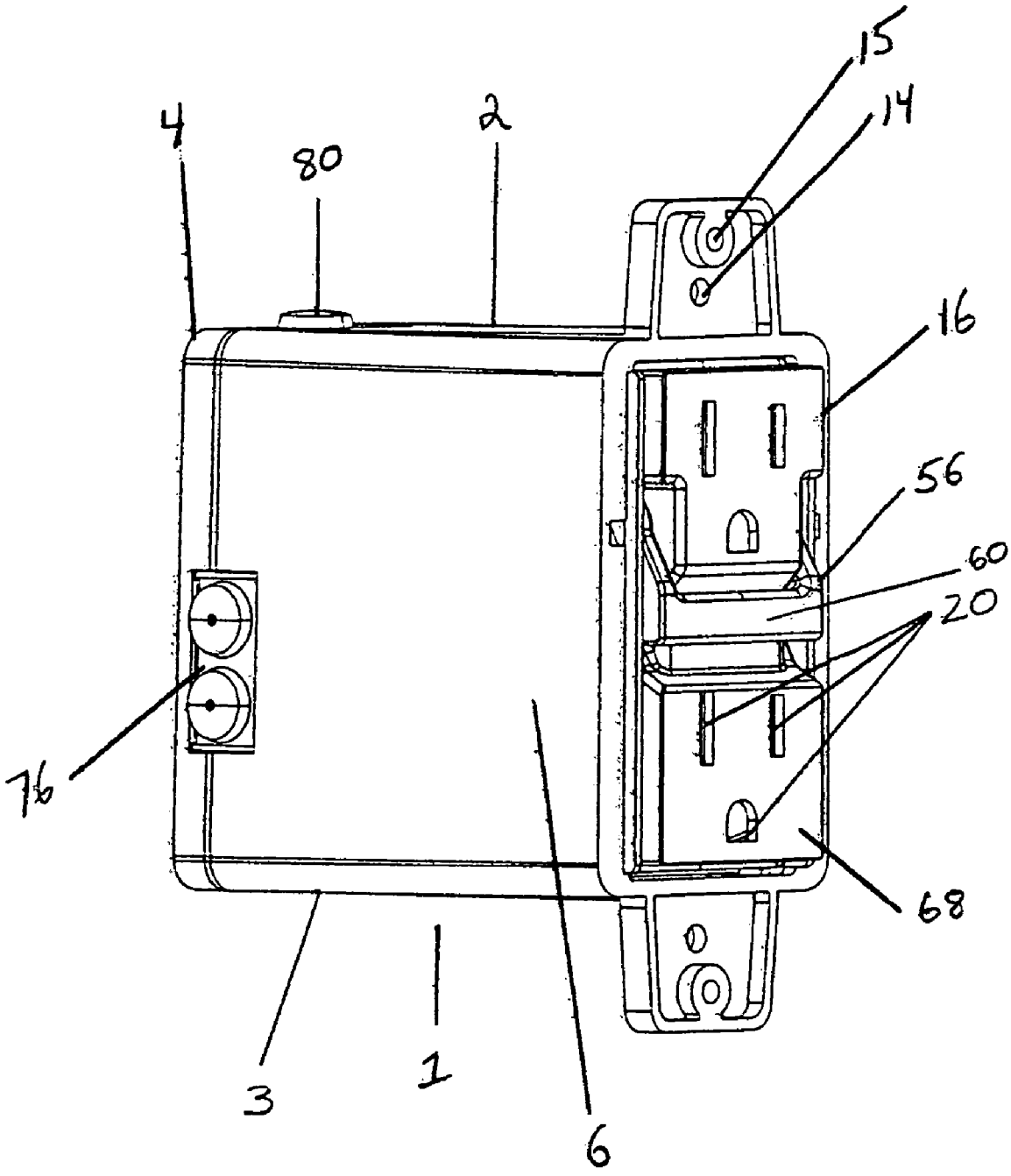
FIG. 1 is an isometric view of a device according to one embodiment of the present invention.
Figure 2:
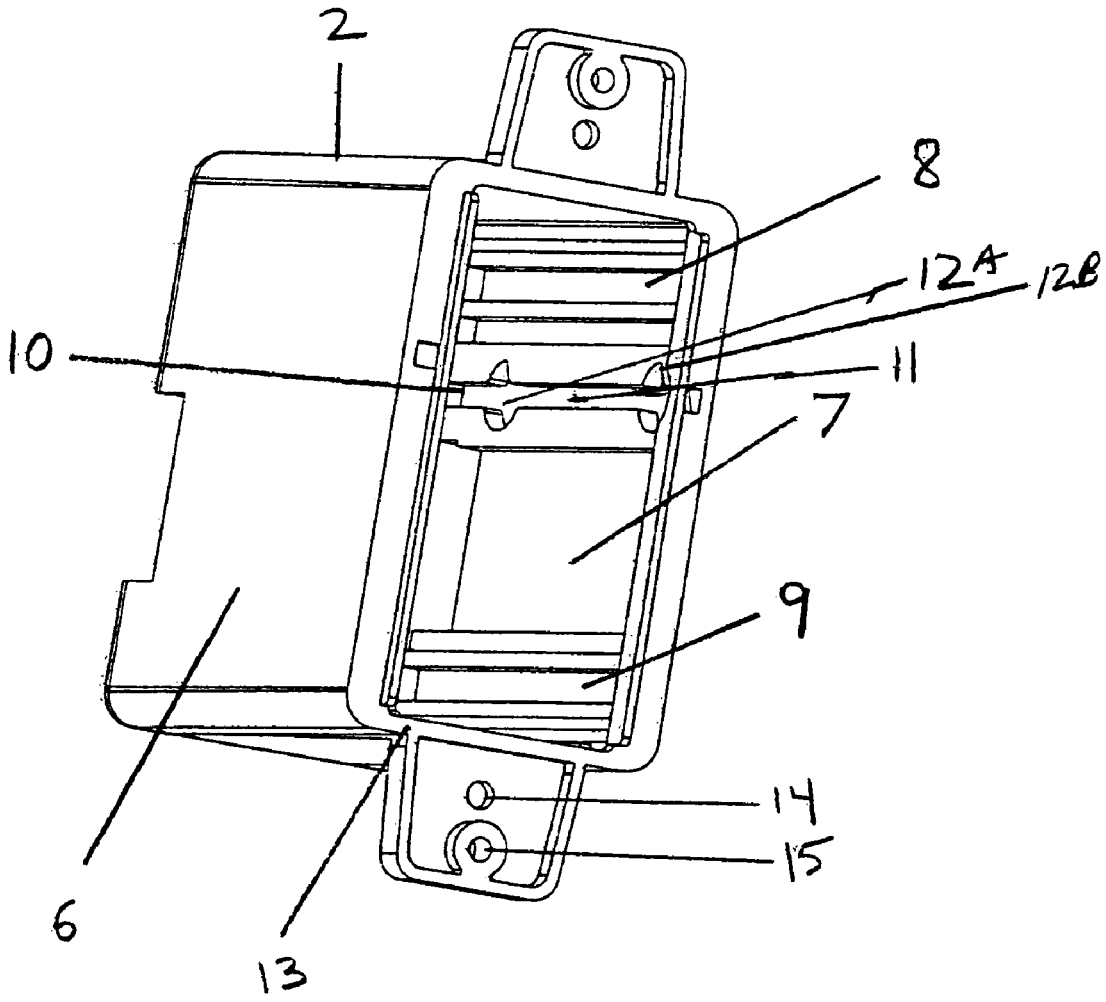
FIG. 2 is an isometric view of some of the elements included in the device of FIG. 1.

With reference to FIGS. 1-4, there is generally shown a flush/recessable junction device 1 in accordance with one embodiment of the present invention. Junction device 1 includes a housing 2. Housing 2 has a body 3 and a back 4. As shown in FIG. 2, the housing may also have opposing walls 6, 7 and substantially parallel upper tracks 8, lower tracks 9, and middle tracks 10 which may be formed on opposing walls 6 and 7. The middle tracks 10 may have movable regions 11 and lockable regions 12A, 12B. Lockable regions 12A may be located proximate to housing back 4 and lockable regions 12B may be located distal to housing back 4. The housing body 2 is open at proximate end 13 opposite housing back 4. More than two lockable regions can also be provided to allow the user to position the receptacle at a plurality of different recessed positions within the housing 2. Although the embodiment shown in FIGS. 1-4 includes tracks, tracks are not necessary. In another embodiment, for example, the receptacle may fit snugly within the house such that the housing itself guides the movement of the receptacle and acts as a track.

Figure 4:
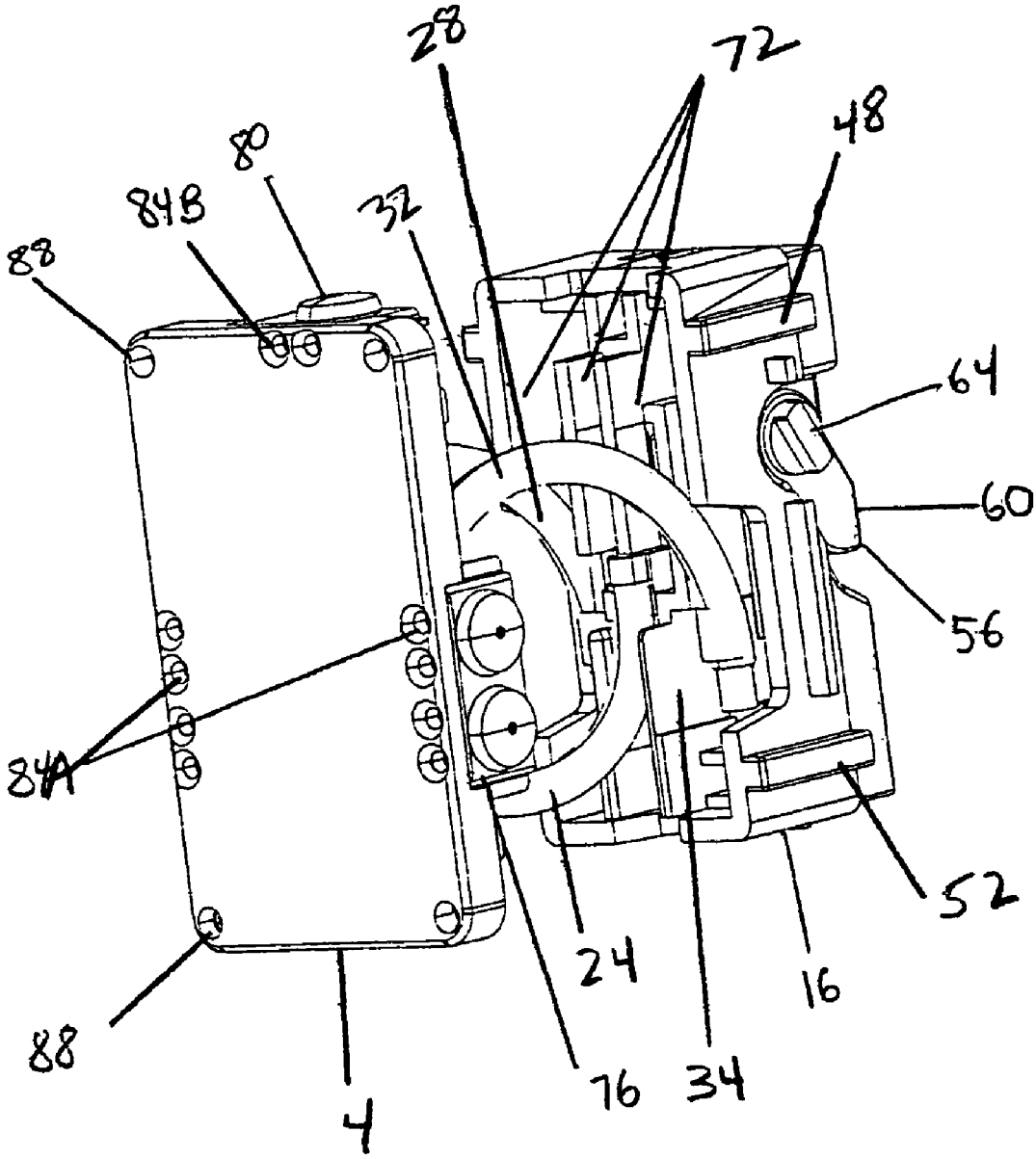
FIG. 4 is an isometric view of some of the elements included in the device of FIG. 1.

The housing body 3 may be connected distally to back 4 with, for example, fasteners, adhesive or may be snap fit to back 4. Alternately, the housing body 3 and back 4 may be integrally molded. The housing body 3 and back 4 are preferably fabricated from a structural material suitable for electrical applications. The housing body includes apertures 14, 15 for mounting the housing to a structure such as an electrical outlet box and for mounting a face or cover plate. As shown in FIG. 4, housing back 4 may include apertures 84A and 84B for connecting the junction device to a power and/or signal source and a ground source and apertures 88 for mounting back 4 to the housing body with, for example, screws. Alternatively, back 4 may be omitted.

Figure 3:
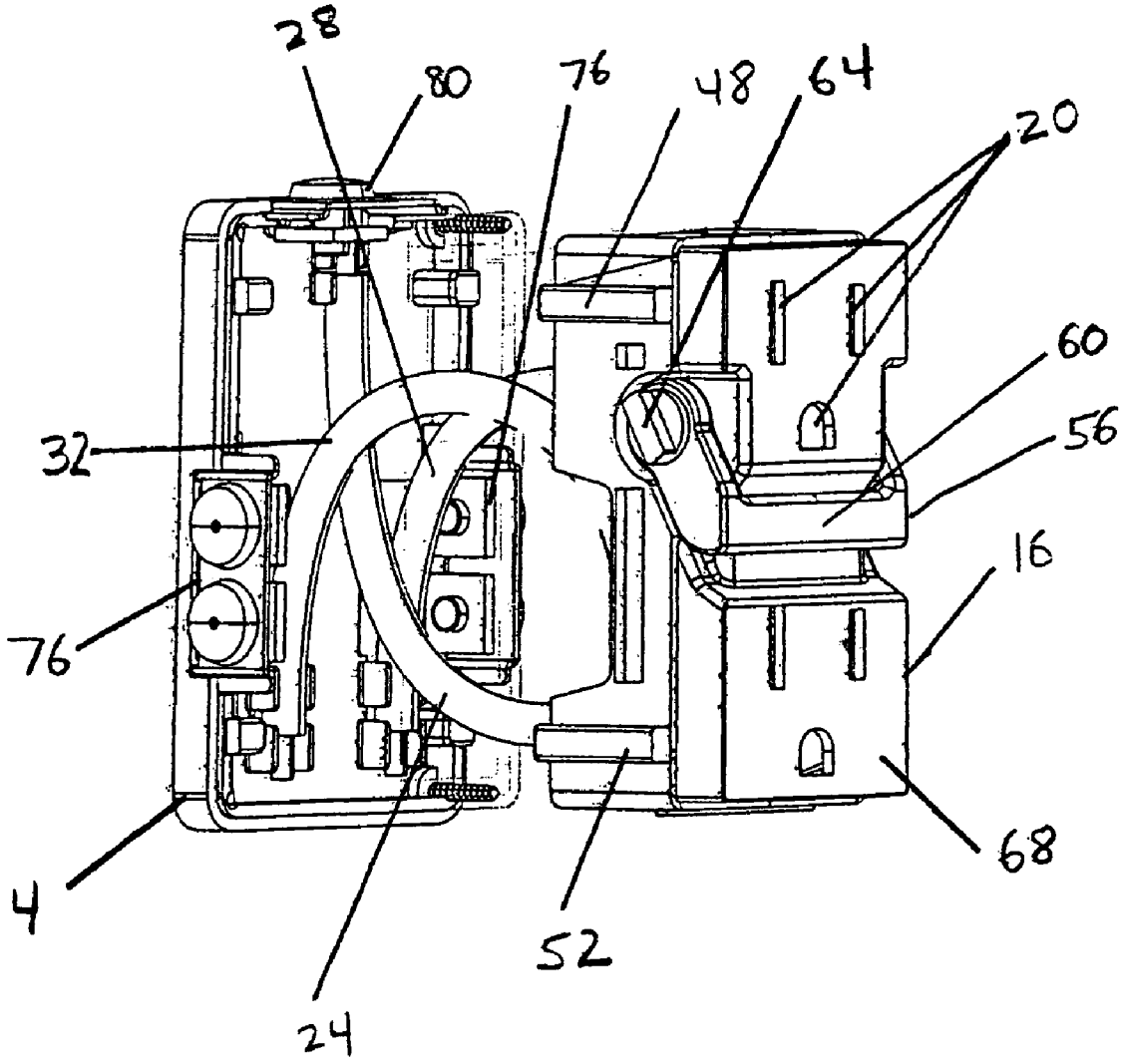
FIG. 3 is isometric view of some of the elements included in the device of FIG. 1.

In a preferred embodiment, junction device 1 includes a first receptacle 16 having apertures 20 configured to accept two male electrical plugs. The junction device may be configured for any number of male plugs and/or female receptacles. Receptacle 16 may also have internal connection wires 24 (ground), 28 and 32 to connect the receptacle to a power and/or signal source or equipment and a ground source through contacts 34 (FIGS. 3, 4). Although wires are depicted in this embodiment, any suitable connection element may be used. The connection elements may be selected to provide an efficient and cost effective connection for the particular type of service required, as for example, electrically conductive metal elements can be used to conduct power. The connection elements may be fixed or movable, and may be flexible or rigid, depending on the requirements of the particular application.

The contacts 34 may comprise a metallic material such as copper or brass. The contacts are disposed in the housing so that they are separated from one another by an insulating material and connected to terminals 76 and 80 (ground). Terminals 76 and 80 are provided for connecting the receptacle to a power and/or signal source and to ground through the wires and contacts.

The receptacle 16 includes rails 48, 52 (FIGS. 3, 4) which can be mounted in upper and lower tracks 8, 9 such that the rails 48 and 52, (two on each side of receptacle 16) slidably mount in the four housing tracks 8, 9. The rails, 48, 52 allow the receptacle 16 to slide along the tracks 8, 9 within the housing 2.

Junction device 1 further includes locking lever 56 which is moveable between a first open position and a second closed position for locking and unlocking the receptacle 16 within the housing 2. Thus, with one motion, a user can both easily and quickly unlock, grasp and then move the receptacle 16 from any locked position to another desirable position and then lock the receptacle at that position. The device is configured such that, for example, moving the device between a locked recessed position and a locked flush position is accomplished with an easy finger-tip motion. The locking lever may be in the configuration of a lever, handle, knob, pull, post, or other like device that a user can grasp in order to move the receptacle back and forth within the housing.

As shown in FIG. 3 the locking lever preferably includes a handle 60 and a rail 64. Rail 64 is sized to fit slidably in middle track 10 (FIG. 2) when that the handle is disposed in an open or upright position and rail 64 is substantially parallel and slidable within middle track 10. Receptacle 16 can slide within the housing 2 such that rails 48, 52, and 64 slide in tracks 8, 9 and 10 respectively. When the locking lever is rotated or moved to the locked position, rail 64 rotates to fit within in a lockable region such as 12A or 12B, and frictionally engages the receptacle 16 to the housing body 2 thus preventing movement of the receptacle 16 within in movable portion 11 of middle track 10. Other locking mechanism besides rail 64 can be used in accordance with the present invention such that rotation, twisting, or other movement of the locking lever itself causes a locking mechanism to lock the receptacle in place, including, by way example, locking pins, brakes or screws that move from a recessed position to a extended position to lock into or against the side walls of the housing 2.

In use, the handle 60 of locking lever 56 may be disposed or moved to a closed position so that the receptacle 16 is locked in a first flush locked position (FIG. 1). In this position, the face 56 of the receptacle 16 is substantially flush (aligned and coplanar) with the proximate end 13 of the housing 2. Preferably, when the locking lever is moved to its locked position it also at the same time moves to a position flush with the face of the receptacle to allow easy coupling without interference by the lever. However, other configurations are possible such that the locking lever can remain in an extended position even when locked, or where the locking lever can move to a locked position, and then be separately moved to a recessed position so as to be flush (or more recessed) with the face of the receptacle. For example, a knob or pull could be the locking lever and could rotate clockwise or counterclockwise to lock and unlock the receptacle, and then could also be separately recessed, such as by a touch and latch mechanism. Thus, in a preferred embodiment, one concept is that the same locking lever may used by a user to grasp and move the receptacle to different positions within the housing as well as to lock the receptacle.

The receptacle can be coupled to a power source and/or signal source to conduct power and/or signals to or from the power and/or signal source with the receptacle remaining in the first position. In this position, rail 64 is disposed in lockable region 12B and frictionally engages the receptacle 16 to the housing 2 thus preventing movement of the receptacle 16 within in movable portion 11 of middle track 10. When the handle 60 is in the closed position, it is substantially flush with the housing and does not protrude, thereby allowing for ease of coupling, efficient use of space and preventing interference and/or damage to or from objects beyond the flush position.

The receptacle 16 can be coupled to said power source and/or signal source to conduct power and/or signals to or from the power and/or signal source with the receptacle remaining in the second locked recessed position. In this position, rail 64 is disposed in lockable region 12A of and frictionally engages the receptacle 16 to the housing body 2 thus preventing movement of the receptacle 16 within in movable portion 11 of middle track 10.

The handle 60 of the locking lever 56 may be disposed in or moved to an open, extending position to unlock the receptacle 16 and allow the user to move the receptacle via the lever to a different recessed position so that the receptacle 16 can then be locked in at least one or more recessed locked positions. Such other locked positions can include a plurality of locking regions and corresponding positions wherein the face 68 of the receptacle 16 is recessed within the housing 2.

The handle 60 may be operated by finger pressure so that movement of the receptacle 16 does not require any specialized tools. The handle 60 may include a fingertip-sized depression or ridge, preferably located at the midline of the handle. If in the form of a knob or a post, for example, the knob or post could have a recessed portion or have a frictional contact portion for easy grasping. In this way, one or two finger operation of the device allows for ease of grasping and movement of the receptacle and provides a finger contact area of maximum safety, located away from any electrical current.

The lever 56 is preferably fabricated from non-conductive structural material such as an engineering polymer or alternatively, the lever may be fabricated from a metal coated with a non-conductive material, such as a polymer.

In an alternate embodiment, the lever can comprise one or more pins which engage corresponding holes formed in the housing at the locked positions. When engaged in the holes, the pins prevent movement of the receptacle within the housing. The lever can be operated to engage and disengage the pins to allow the receptacle to be locked in two or more locked positions, and to move within the housing.

In an embodiment which includes wires, the housing 2 also preferably includes wire guides 72 formed in receptacle 16 (FIG. 4). The guides 72 form channels for guiding wires 24, 28 and 32. The guides are preferably integrally molded with the receptacle using non-conductive material but may comprise separate components or be formed in the housing back 4 or both. The guides separate the wires from one another, thus acting as a safety feature by insulating the wires from one another. Further, the guides may help prevent tangling or overlapping of the wires with one another, thus allowing for reliable movement of the receptacle to or from any locked position in the housing. In use, the wires are guided when the receptacle is moved from the flush locked position to any recessed locked position and vice versa. The wires may be partially or fully disposed within the channels.

Figure 5:
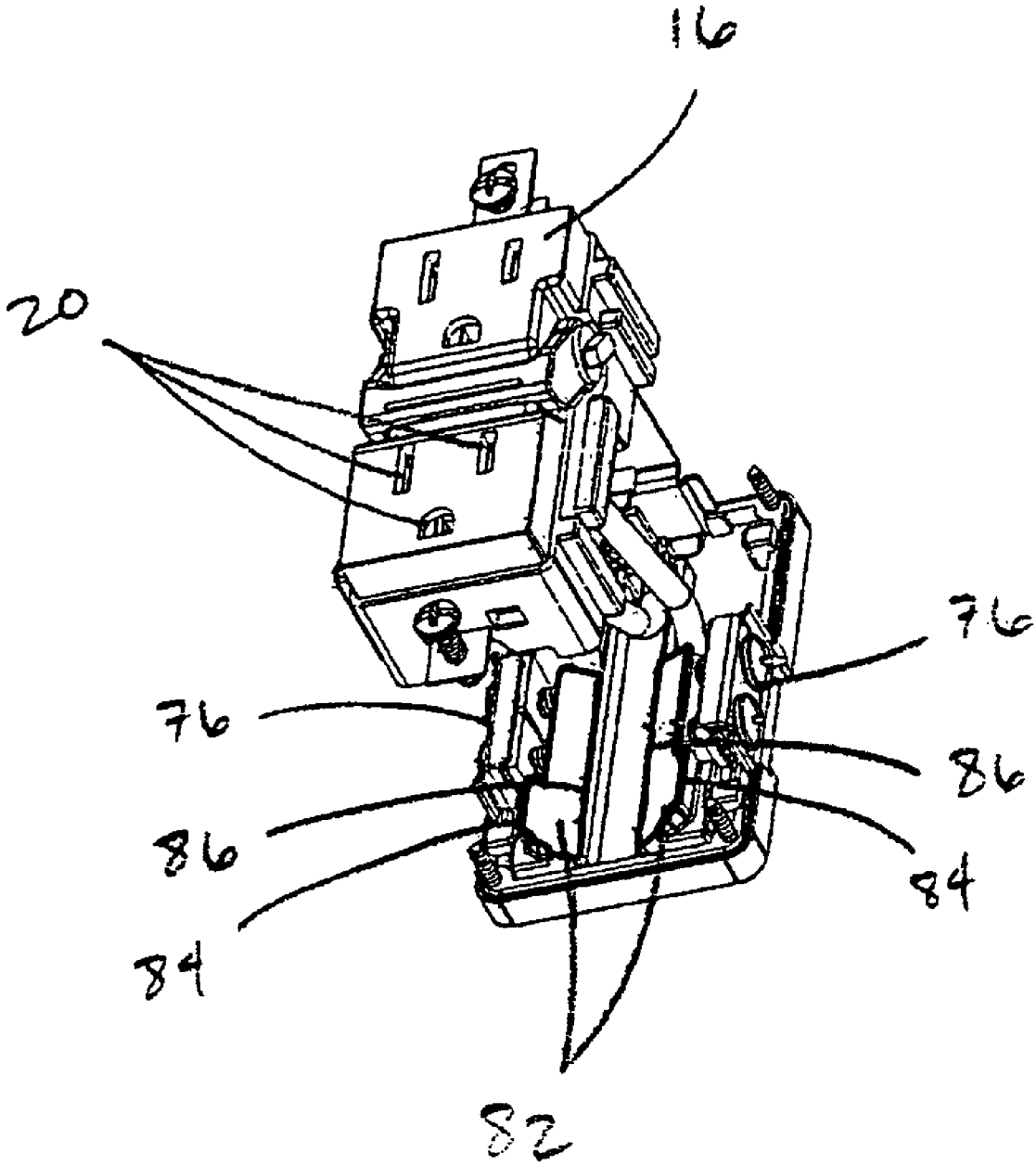
FIG. 5 is an isometric view of elements of an embodiment of the present invention including wire guides and/or terminal protectors.

In another preferred embodiment, as shown in FIG. 5, one or more terminal protectors 82 having angled surfaces may be positioned adjacent to the housing back 4. The angled surfaces of the terminal protectors 82 may have outside edges 84 positioned proximate outside walls 6, 7 of the housing 2 (shown in FIGS. 1 and 2) and remote from housing back 4, as well as inside edges 86 positioned remote from outside walls 6, 7 of the housing 2 and proximate the housing back 4. Thus configured, terminal protectors 82 provide a barrier between contacts 76 and wires 24, 28, and 32 as the receptacle 16 of the junction device moves and locks into a recessed position.

In practice, as the receptacle 16 moves into a recessed position, the wires, such as, for example, the ground wire 24, are pushed into a decreased amount of space between the receptacle 16 and the housing back 4. Also located in this space are contacts 76. As the space becomes smaller, the likelihood of the wires, such as ground wire 24, contacting the contacts 76 increases. Such contact is undesirable as it may cause shorting or other problems. Terminal protectors 82, however, can be used to provide a barrier between the wires, such as ground wire 24, and the contacts 76. Moreover, the terminal protectors are preferably provided with angled surfaces to help direct the wires away from the contacts 76 and towards one or more wire channels in the center of the device.

In alternative embodiments, other geometries and configurations of the rails and complementary tracks such as a half round, or flat-sided geometries having any number of flat walls, or geometries having a combination of curved and flat walls may be utilized depending on the structural loading and size requirements of a particular application.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The invention claimed is:

1. A recessable junction device comprising:

a body having at least one track, the at least one track having a plurality of locking regions spaced apart from one another and including at least a first locking region and a second locking region;

at least one receptacle configured to connect with a power source or signal source, or both a power and a signal source, the at least one receptacle slidably mounted within the body by engagement with the at least one track; and the at least one receptacle comprising a locking lever having an unlocked and extended position to allow grasping of the locking lever to move the at least one receptacle relative to the body to each of the locking regions, and a locked position that prevents movement of the at least one receptacle relative to the body at each of the plurality of locking regions, wherein the at least one receptacle is configured to move between at least the first and second locking regions and to lock in place at each locking region upon movement of the locking lever to the locked position.

2. The recessable junction device of claim 1, wherein the receptacle comprises a face and the body comprises a front face, and wherein at least two of the plurality of locking regions correspond to:

a first locked position wherein the face of the at least one receptacle is substantially aligned with the front face of the body; and a second locked position wherein the face of the at least one receptacle is remote from the front face of the body and substantially recessed within the body.

3. The recessable junction device of claim 1, wherein movement of the locking lever to the second locked position locks the at least one receptacle at two opposing locking regions.

4. The recessable junction device of claim 1, wherein the receptacle is connectable to a power source and/or signal source by one or more wires, and the recessable junction device further comprises one or more wire guides comprising one or more channels for retaining at least portions of the wires within the channels when the at least one receptacle is moved between the locking regions.

5. The recessable junction of claim 1, wherein the body further comprises at least one contact terminal, at least one wire guide, and at least one terminal protector, wherein the at least one receptacle is connected to at least one wire, and wherein the at least one terminal protector is positioned at an angle towards the at least one wire guide and between the at least one contact terminal and the at least one receptacle to assist the guidance of the at least one wire into the at least one wire guide and provide at least a partial barrier between the at least one wire and the at least one contact terminal.

6. A recessable junction device comprising:

a body comprising at least one contact terminal, the body further defining an opening having a receptacle disposed therein, wherein the receptacle is moveable within the opening between a plurality of positions relative to the body;

at least one wire connecting the receptacle and the at least one contact terminal, wherein the at least one wire remains connected to the receptacle and the at least one contact terminal at all of the plurality of positions of the receptacle relative to the body; and at least one wire guide formed within the receptacle, the at least one wire guide comprising one or more channels for retaining at least portions of the at least one wire connected to the receptacle within the channels when the receptacle is moved between positions.

7. The recessable junction device of claim 6, wherein the receptacle has at least one receptacle surface and the body has at least one external surface, and wherein the receptacle surface is substantially flush with the external surface of the body when the receptacle is in at least one of the plurality of positions and the receptacle surface is substantially recessed from the external surface of the body when the receptacle is in at least another one of the plurality of positions.

8. The recessable junction device of claim 6, wherein the body further comprises at least one contact terminal and at least one terminal protector, and wherein the at least one terminal protector is positioned at an angle towards the at least one wire guide and between the at least one contact terminal and the at least one receptacle to assist the guidance of the at least one wire into the wire retaining channel and provide at least a partial barrier between the at least one wire and the at least one contact terminal.

9. A recessable junction device comprising:

a body comprising one or more contact terminals and defining an opening, the opening having a receptacle disposed therein, wherein the receptacle is moveable between a plurality of positions relative to the body; and the body further comprising one or more terminal protector walls positioned at an angle between the contact terminals and bendable wiring connected to the receptacle to assist guiding at least a portion of the wiring away from the contact terminals during movement of the receptacle within the opening.

10. The recessable junction device of claim 9, wherein the receptacle has at least one receptacle surface and the body has at least one external surface, and wherein the receptacle surface is substantially flush with the external surface of the body when the receptacle is in at least one of the plurality of positions and the receptacle surface is substantially recessed from the external surface of the body when the receptacle is in at least another one of the plurality of positions.

11. The recessable junction device of claim 9, wherein the receptacle comprises a locking lever having a first unlocked position to allow grasping of the locking lever to move the receptacle within the body and a second locked position wherein a locking movement of the locking lever causes the receptacle to lock at a desired one of the plurality of positions.

12. A recessable junction device comprising:

a housing having a body, the body having a first locking region and at least a second locking region spaced from each other;

at least one receptacle connectable to a power source and/or signal source, the at least one receptacle being movable within the housing between at least the first locking region and the at least one second locking region and configured to lock in place at each locking region; and a locking lever connected to the at least one receptacle and having one or more locking elements, the locking lever being movable between (i) a first open position for grasping by a user to allow the user to move the at least one receptacle between the first and the at least one second locking regions and (ii) a second closed position by which movement of the locking lever from the first open position to the second closed position causes the one or more locking elements to engage and lock the receptacle against the housing to prevent movement of the receptacle within the housing at each locking region.

13. The recessable junction device of claim 12, wherein the housing comprises slots, and the locking lever comprises rails that change position as the locking lever is moved from the first open to the second closed position to engage the slots of the housing.

14. The recessable junction device of claim 12, wherein the locking lever is movable to a position flush with the face of the receptacle when the receptacle is in a locked position with respect to the housing and movable to a position outwardly extending from the face of the receptacle when the receptacle is moveable with respect to the housing.

15. The recessable junction device of claim 12, wherein the receptacle comprises a plurality of outlets, each outlet being connectable to a power source and/or a signal source, and wherein the locking lever is arranged between at least two of the plurality of outlets.

16. A method of moving and locking at least one movable receptacle in a recessable junction device comprising:

providing a recessable junction device comprising a body having at least one track, the at least one track having a plurality of locking regions spaced apart from one another and including at least a first locking region and a second locking region, the recessable junction device having at least one receptacle configured to connect with a power source or signal source, or both a power source and a signal source, the at least one receptacle being slidably mounted within the body by engagement with the at least one track, the receptacle junction device comprising a locking lever having an unlocked position and extended position to allow grasping of the locking lever to move the at least one receptacle relative to the body to each of the locking regions, and a locked position that prevents movement of the at least one receptacle relative to the body at each of the plurality of locking regions, wherein the at least one receptacle is configured to move between the at least first and second locking regions and to lock in place at each locking region upon movement of the locking lever to the locked position;

moving the locking lever to the unlocked position;

grasping the locking lever while in the unlocked position to move the at least one receptacle to the first locking region;

moving the locking lever to the locked position to lock the at least one receptacle in the first locking region;

moving the locking lever to the unlocked position to unlock the at least one receptacle from the first locking region;

grasping the locking lever while in the unlocked position to move the at least one receptacle to the second locking region; and moving the locking lever to the locked position to lock the at least one receptacle at the second locking region.

17. The method of claim 16, wherein the locking lever includes one or more rails slidable within the at least one track, and further comprising rotating the locking lever to change the position of the rail to lock the at least one receptacle.

18. The method of claim 16, wherein the steps of moving the locking lever to the unlocked position, grasping the locking lever while in the unlocked position to move the receptacle to the first locking region or the second locking region, and moving the locking lever to the locked position, are carried out with one fluid motion.

* * * * *